United States Patent [19]

Mackal

[11] 4,441,629

[45] Apr. 10, 1984

[54] COMPRESSED GAS POWERED CAULKING GUN

[76] Inventor: Glenn H. Mackal, 4923 59 Ave. S., St. Petersburg, Fla. 33702

[21] Appl. No.: 406,951

[22] Filed: Aug. 10, 1982

[51] Int. Cl.[3] ..... B65D 88/54; B67D 5/42

[52] U.S. Cl. ..... 222/324; 222/80; 222/389; 222/396; 137/115; 137/119

[58] Field of Search ..... 137/115, 119; 222/261, 222/262, 263, 324–327, 386, 389, 396, 397, 3, 399, 80, 81

[56] References Cited

U.S. PATENT DOCUMENTS

| | | | |
|---|---|---|---|
| 3,285,469 | 11/1966 | Perisse | 222/3 |
| 3,570,523 | 3/1973 | Pauliukonis | 137/119 |
| 3,768,472 | 10/1973 | Hodosh et al. | 222/389 X |
| 3,856,041 | 12/1974 | Cryder et al. | 137/115 X |
| 3,908,688 | 9/1975 | Gandrud | 137/115 X |
| 3,980,209 | 9/1976 | Collar | 222/323 |
| 4,113,151 | 9/1978 | Brown et al. | 222/324 |

FOREIGN PATENT DOCUMENTS

| | | | |
|---|---|---|---|
| 837532 | 6/1960 | United Kingdom | 137/119 |

*Primary Examiner*—F. J. Bartuska
*Assistant Examiner*—Michael S. Huppert

[57] ABSTRACT

Pressure reducing and safety discharge valve device adapted for use with compressed gas-containing capsules. The valve has a bore therein in which a spool-shaped valve element is disposed for axial reciprocation. In a first terminal position of the valve element the valve element connects a conduit means leading from a gas-containing capsule discharging gas under moderate pressure to a gas-discharge port of the valve. When the pressure of the gas discharged from the capsule increases to a predetermined value, the valve element moves against the opposition of a spring to cut off further discharge of gas from the capsule; when the pressure of the gas discharged from the capsule increases substantially beyond such predetermined value, the valve element moves still further against the opposition of the spring to discharge such gas through a relief port to the atmosphere.

6 Claims, 3 Drawing Figures

Figure 1:
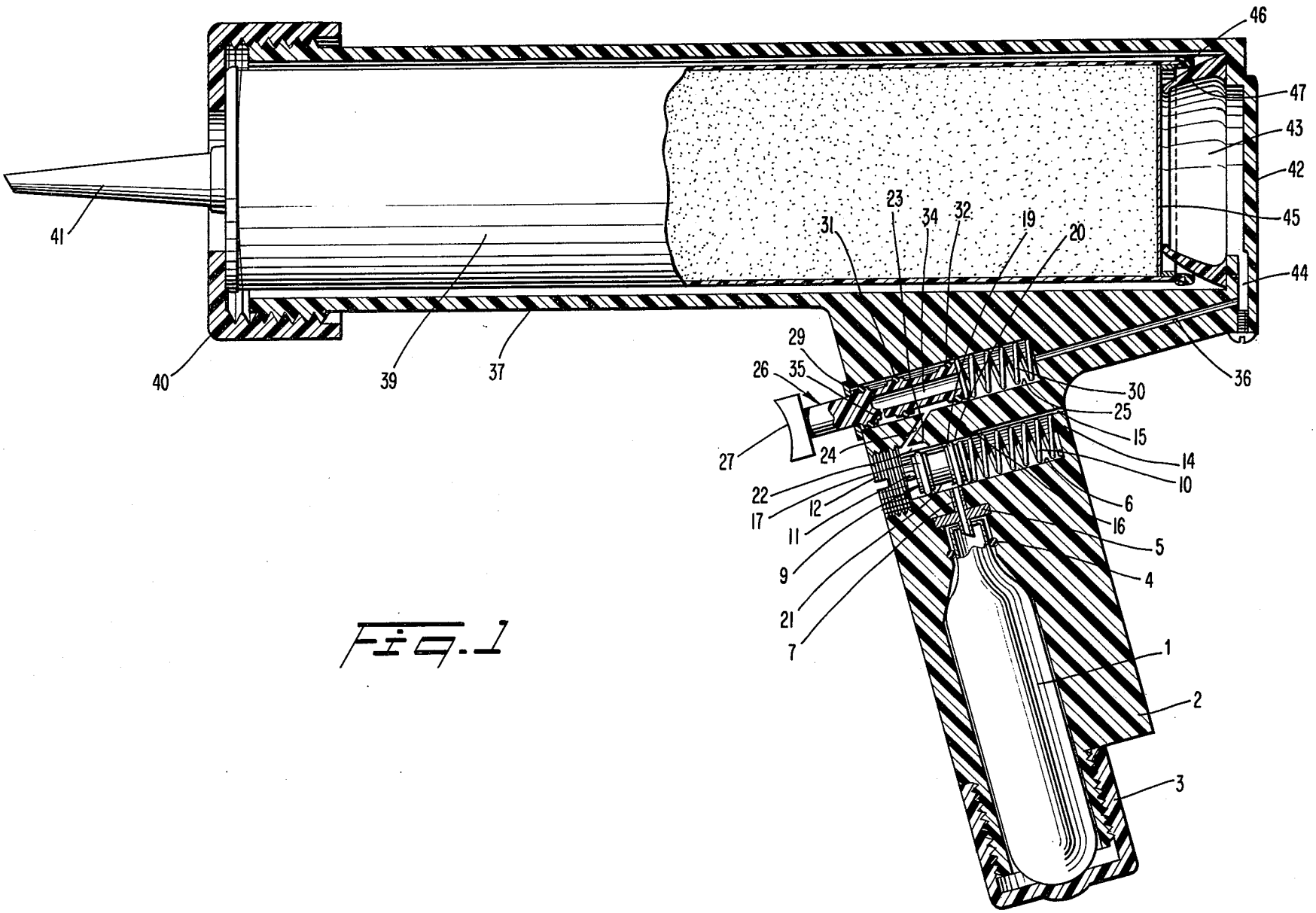

Fig. 2
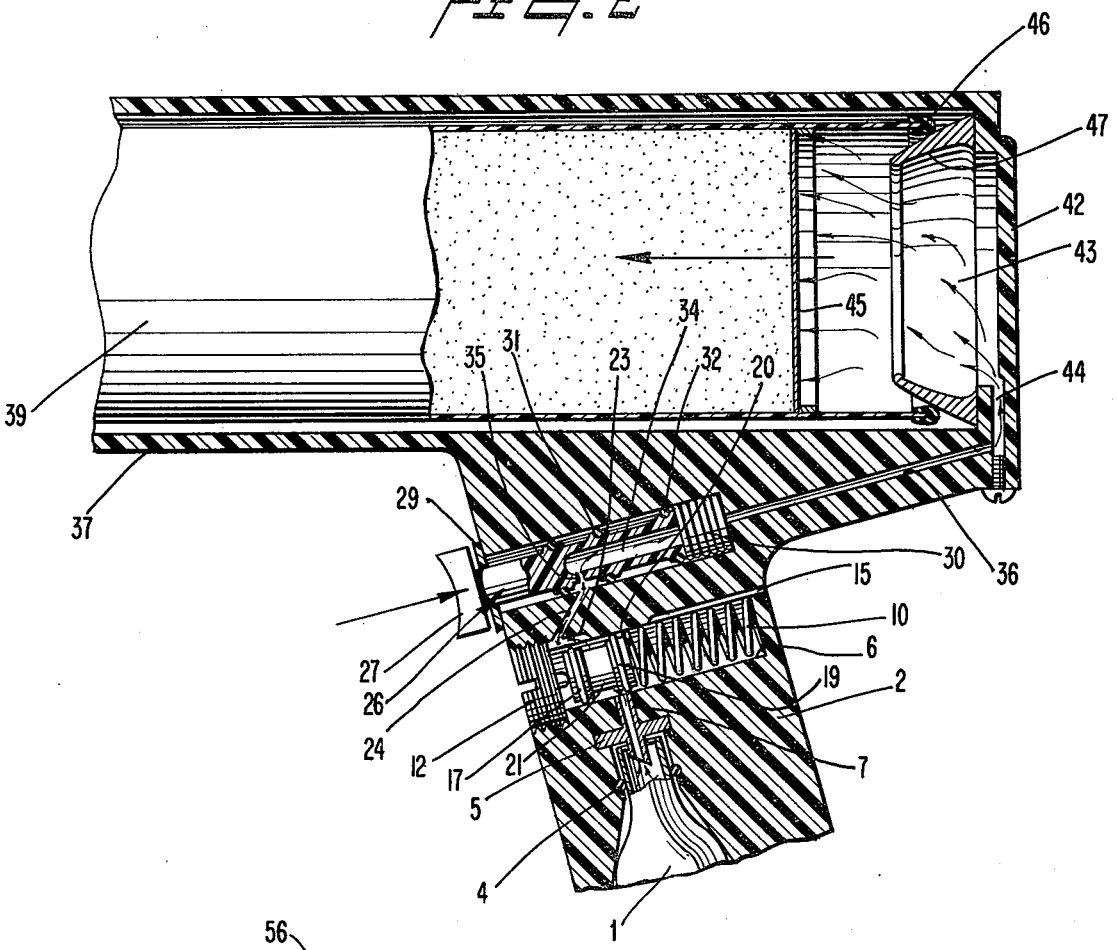
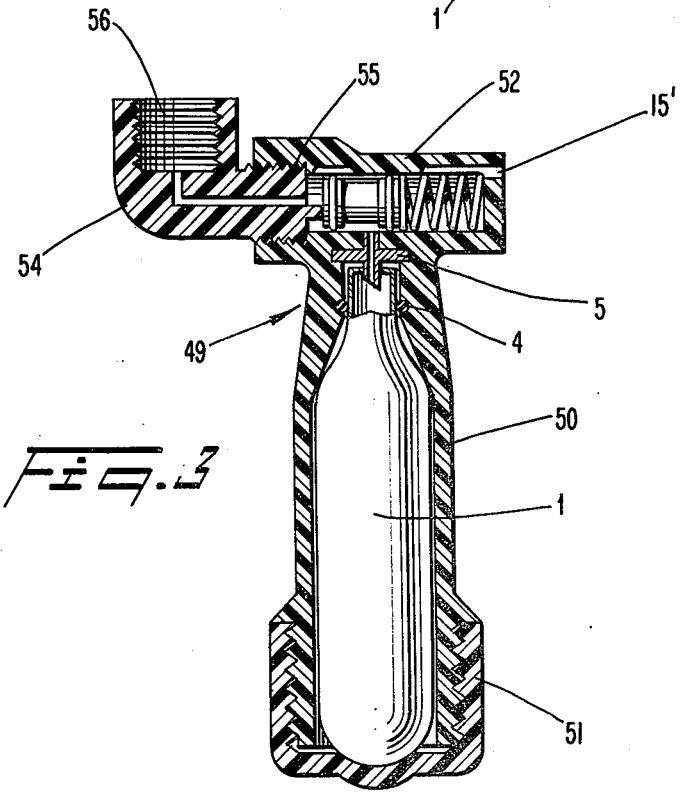
Fig. 3

COMPRESSED GAS POWERED CAULKING GUN

This invention relates to a compressed gas powered caulking gun, and to a mechanism for automatically regulating the pressure of gas delivered thereto from a compressed gas containing cartridge.

Air operated caulking guns are presently available. They have the distinct advantage of smoother operation and requiring less manual effort than manually operated caulking guns. However, they also have the disadvantage of requiring an air compressor in order to operate. Since it is frequently inconvenient and often impossible to have an air compressor available when doing caulking, it is desirable to operate the caulking gun from a small, readily available means such as a compressed gas cylinder. A $CO_2$ cylinder is just such a means.

The invention includes not only a new type of caulking gun, which can be operated only by compressed gas cylinders, but also a device functioning as an adapter for receiving compressed gas cylinders and for attachment to existing air operated caulking guns. Regardless of whether the device is a new type of caulking gun operated only by $CO_2$ cylinders, or the combination of previously available air operated caulking guns with a $CO_2$ cartridge adapter, the apparatus of the invention includes a means for piercing a $CO_2$ cylinder with negligible gas loss, a means for regulating the pressure of the gas issuing from the $CO_2$ cylinder to a safe level, optionally a check valve which allows the operator to change the gas cylinders without loss of gas pressure from the caulking gun, and an over-pressure relief feature which relieves the gas pressure in the event of a sealing failure, thereby protecting the operator.

The apparatus of the invention will be more fully understood upon consideration of the accompanying drawings, in which:

FIG. 1 is a view partially in vertical axial section and partially in side elevation of a first embodiment of apparatus of the invention, such apparatus including a gas operated caulking gun which incorporates an integrally included compressed gas source and pressure regulating means therefor, the pressure regulating means including a valve which is shown closed in FIG. 1;

FIG. 2 is a fragmentary view of the pressure regulating means of FIG. 1, the valve being shown in FIG. 2 in open position; and FIG. 3 is a view partially in axial section and partially in side elevation of a unit adapted for attachment to a conventional air operated caulking gun, said unit including means for receiving a compressed gas containing capsule and means for controlling the pressure of gas issuing from said capsule.

Turning first to FIG. 1, a $CO_2$ cartridge 1 is contained in a cavity in a body 2 which is integral with the housing of the caulking gun, body 2 forming a handle for such gun. The lower end of body 2 is closed by a cap 3 which has threaded engagement therewith. The neck of the capsule is engaged with an O-ring 4 so that when the capsule is disposed as shown in FIG. 1 a seal is established between the capsule and the body 2. At the upper end of the cavity within the body 2 there is disposed transversely thereof a compressible sealing means 5 made, for example, of soft rubber through which there extends a tubular piercing pin 7 the upper or rear end of which is fixedly attached to the body 2. When a gas containing capsule 1 is inserted within the cavity in the body 2 and the cap 3 is screwed home, the lower sharpened bevelled end of the piercing pin pierces a sealing means at the end of the neck of the capsule so that the gaseous contents of the capsule can now escape through the piercing pin 7 into a part of a first, transverse bore 6 in the body 2.

A movable valve element 9 is mounted for reciprocation within the bore 6. Element 9 is constantly urged to the left by a coil compression spring 10 one end of which engages the inner end of an end wall 14 of the bore 6 and the other end of which engages the right-hand end of the movable valve element 9. The left-hand end of the bore 6 is closed by a plug 12 which is screwed into such end of the bore, such plug bearing a central, inwardly directed stop pin 11 which defines the left-hand end of the path of travel of the movable valve element 9.

The movable valve element 9 is in the form of a spool having O-rings 17 and 19 mounted in grooves therein at opposite ends, the portion 21 of the movable valve element 9 between the O-rings 17 and 19 being of reduced diameter, as shown. With the part in the positions shown in FIG. 1, gas flowing from a cartridge 1 travels through the hollow piercing pin 7 into the portion of bore 6 surrounding the central portion 21 of the movable valve element 9 and thence travels through a groove 22 at the rear end of the bore 6, into the entering end of an angularly disposed passage 24 to a valve 26, to be described hereinafter, which is then closed. The groove 22 extends from the rear or left-hand end of the bore 6 in body 2 to an end or threshold 23 which is disposed above the reduced diametered part 21 of the movable valve element 9 when the parts are in the positions thereof shown in FIG. 1.

Gas escapes from the capsule 1 at high pressure. It is prevented from filling the cylinder compartment in body 2 by the O-ring 4. It travels through the piercing pin 7 into the regulator chamber formed within the rear or left-hand end of the bore 6. It surrounds the part 21 of the movable valve element 9 and when the parts are in the position shown in FIG. 1 acts upon the left-hand surface of O-ring 19 as well as the enlarged right-hand end portion of the movable valve element, and the right-hand end surface of the O-ring 17 as well as the enlarged left-hand end portion of the movable valve element 9. These two forces acting upon the movable valve element 9 cancel each other since they are in equilibrium. However, a further force resulting from the fluid pressure acting upon the left-hand end surface of the movable element as well as the left-hand surface of the O-ring 17 thereon urges the movable valve element to the right, and is countered by the force exerted on such element by the coil compression spring 10.

Larger gas pressures thrust the movable valve element 9 to the right against the opposition of spring 10 until O-ring 17 engages and forms a seal with the threshold 23, thus cutting off further flow of gas into the grooves 22 and 24. The gas issuing from the hollow piercing pin 7, of course, continues to act upon the left-hand end of the movable valve element 9. If O-ring 17 should be defective, the movable valve element 9 will be pushed even further to the right passing even the left-hand end 16 of a shallow axially extending groove which extends to a discharge port 15 at the right-hand or end surface of the body 2. Without this safety feature, failure of O-ring 17 could potentially cause a build-up of pressures in the gas receiving space 43 in the rear end of the caulking gun cylinder, causing the gun to explode.

A second bore 25 is provided above and parallel to the bore 6 in body 2. A valve element 26 is mounted for reciprocation within the bore 25, valve element 26 being constantly urged to the left, in valve closed position, by a coil compression spring 30. A button or trigger 27 is provided on the outer, left-hand end of the valve element 26; thrusting of the valve element 26 to the right as by the engagement of one's thumb with trigger 27 causes the valve element 26 to move to the right into its valve-open position. An annular retainer member 29 acts as an abutment to prevent further movement of the valve element to the left from the position thereof shown in FIG. 1.

Valve element 26 has three O-rings disposed thereon in longitudinally spaced position, the left-most O-ring preventing leakage of the gas to the atmosphere from the left-hand end of the bore 25. The two remaining O-rings, 31 and 32, are disposed in grooves in portions of the valve of increased diameter which bound the forward and rear ends of a portion of the valve of reduced diameter which confronts the exit end of the slanting passage 24 in body 2. Valve element 26 has a central bore 34 extending from its right-hand end to a position near the left-hand end thereof where it communicates through a radial bore 35 with the bore 25. The right-hand end of the bore 25 communicates with a further, narrower bore 36 which extends to a radially extending bore 44 at the rear end of the caulking gun cylinder 37.

As can be seen in FIG. 2, when the valve element 26 is thrust to the right into its valve-open position, gas under pressure travels through passage 24 through the radial passage 35 into the axial bore within the valve element 26, and thence through passages 36 and 44 to the rear end of the caulking gun cylinder 37.

In use, the caulking gun is provided with a capsule or caulking material containing cartridge 39 which is inserted into the cylinder 37 of the gun through the forward end thereof, following which a cap 40, bearing a central discharge nozzle 41, is screwed onto the forward end of the barrel 37. The gun has a transverse rear end closure member 42 through which the above-mentioned passage 44 extends at the bottom thereof. The cartridge 39 is provided with a transverse rear end closure 45 in the form of a shallow cup having an annular sealing member 46 disposed about the rear edge of its annular side wall. The gun has inwardly thereof at it rear end an annular flexible sealing member 47, the thickened rear end portion of member 47 being fixedly secured to the rear inner end surface of the cylinder of the caulking gun, whereas, in the starting position shown, the thinner more easily flexible annular forward edge thereof extends within the annular rearwardly extending wall of the member 45.

When the space 43 within the rear end of the cylinder 37 of the caulking gun is subjected to gas under pressure, as above described, such gas thrusts the forward flexible annular edge portion of member 47 radially outwardly into sealing engagement with member 46 on the closure and/or plunger member 45. Progressive travel of member 45 to the left results in the unfolding of the seal 46 so that it continues to form a seal between member 45 and the metallic side wall of the cartridge 39, and causes the forward flexible end of sealing member 47 to expand outwardly into sealing engagement with the rear end of the metallic casing of the capsule 39 after the plunger 45 has moved sufficiently to the left to permit member 47 to engage the metallic housing of the cartridge 39.

In FIG. 3 there is shown a unit whereby commercially available conventional gas powered caulking guns may be converted to guns powered by compressed gas contained in cartridges or capsules. In such figure there is shown a T-shaped housing 49 having a vertical hollow portion 50 which receives a gas containing capsule 1, the lower end of portion 50 being closed by a screw cap 51. The upper horizontal part of the T-shaped housing 49, designated 52, has a left-hand, elbow portion 54 which is screw threaded at 55 to the housing part 52. Part 54 has a left-hand vertically disposed internally threaded part 56 which may be screwed upon the input pipe or fitting of a conventional gas powered caulking gun. A gas pressure controlling means, identical with that above described in the embodiment of FIGS. 1 and 2, is mounted within the housing part 52.

Although the invention is illustrated and described with reference to a plurality of embodiments thereof, it is to be expressly understood that it is in no way limited to such preferred embodiments but is capable of numerous modifications within the scope of the appended claims.

I claim:

1. A pressure reducing and safety discharge valve device adapted for use with compressed gas-containing capsules, comprising a valve body having a first bore therein, a first spool-shaped valve element in the first bore reciprocable axially within the bore, the first valve element having disc-shaped transverse first and second flanges on its opposite ends and an intermediate portion between the flanges of reduced diameter, annular means on the respective flanges having sealing and sliding engagement with the wall of the first bore, resilient means constantly urging the valve element in a first direction toward a first, terminal position thereof wherein the first flange on the valve element lies adjacent a first end of the first bore and the second flange lies remote from the said first end of the first bore, a first conduit means including a first, fluid pressure feeding port in the wall of the first bore disposed to discharge fluid under pressure from a gas-containing capsule into the space within the bore at a location between the flanges on the valve element when the movable valve element is in its first, terminal position, a second, fluid discharge port in the wall of the first bore disposed between the flanges on the valve element when the valve element is in its first, terminal position, and a third, fluid pressure relief port in the wall of the first bore disposed axially in the second direction beyond the other, second flange of the valve element when the valve element is in its first, terminal position, when the valve element is in its first terminal position the distance between the axial distance between the first flange thereof and the second port is substantially less than the axial distance between the second flange and the third port, whereby when the pressure of the fluid medium entering the first port is from zero to a moderate value the valve element does not move from its first, terminal position and gas is delivered from the valve through the second port, but when the pressure of the gas being fed through the first port exceeds a predetermined desired value the valve element is first moved away from its first, terminal position to cut off fluid communication between the first and second ports, and if the pressure of the fluid medium being fed through the first port continues to rise the valve element moves further in the second direction so that communication is established between the first and third ports, whereby to provide fluid pressure relief discharge of the fluid medium through the third port.

2. A device according to claim 1, comprising a selectively operable shut-off valve in said valve body, said shut-off valve being interposed in a second conduit means interposed in the valve body and connected to said second, fluid discharge port.

3. A device according to claim 2, wherein said valve body has means receiving a compressed gas-containing capsule.

4. A device according to claim 3, in combination with a compressed gas-powered tool wherein the valve body forms the handle of said tool.

5. The combination according to claim 4, wherein the tool is a caulking gun having a cylinder receiving a caulking material-containing capsule.

6. A device according to claim 2, wherein the device is adapted for attachment to a conventional compressed air-powered tool to serve as the source of power therefor.

* * * * *